US007631377B1

(12) United States Patent
Sanford

(10) Patent No.: US 7,631,377 B1
(45) Date of Patent: Dec. 15, 2009

(54) BED VENTILATOR UNIT

(76) Inventor: Alonzo W. Sanford, P.O. Box 124, North Street, MI (US) 48049

( * ) Notice: Subject to any disclaimer, the term of this patent is extended or adjusted under 35 U.S.C. 154(b) by 0 days.

(21) Appl. No.: 12/170,123

(22) Filed: Jul. 9, 2008

(51) Int. Cl.
*A47C 21/04* (2006.01)
*A47G 9/04* (2006.01)

(52) U.S. Cl. ..... 5/423; 5/482; 5/413 R; 607/107

(58) Field of Classification Search ..... 5/423, 5/421, 482, 413 R, 941, 502, 500, 658, 494; 607/107
See application file for complete search history.

(56) References Cited

U.S. PATENT DOCUMENTS

| | | | | |
|---|---|---|---|---|
| 2,560,349 | A | 7/1951 | Inglis | |
| 3,230,556 | A * | 1/1966 | Shippee | 5/423 |
| 3,928,876 | A | 12/1975 | Starr | |
| 5,730,120 | A | 3/1998 | Yonkers, Jr. | |
| 6,473,920 | B2 | 11/2002 | Augustine et al. | |
| 6,493,889 | B2 * | 12/2002 | Kocurek | 5/423 |
| 6,701,552 | B2 * | 3/2004 | Suzuki et al. | 5/421 |
| 6,730,115 | B1 | 5/2004 | Heaton | |
| 7,036,163 | B2 * | 5/2006 | Schmid | 5/423 |
| 7,181,786 | B2 | 2/2007 | Schoettle | |
| 2005/0278863 | A1 | 12/2005 | Bahash et al. | |

FOREIGN PATENT DOCUMENTS

| | | |
|---|---|---|
| DE | 10012617 | 9/2001 |
| FR | 2641455 | 7/1990 |
| FR | 2835164 | 8/2003 |
| GB | 2.225.535 | 6/1990 |
| GB | 2.416.833 | 2/2006 |

* cited by examiner

*Primary Examiner*—Alexander Grosz
(74) *Attorney, Agent, or Firm*—Michael I Kroll

(57) ABSTRACT

A ventilating system for a bed for selectively venting either ambient air or heated air into the bed linen of a bed approximate the foot of the bed through a pair of vents clipped to the mattress in spaced apart fashion. with a pliable partition longitudinally extending the length of the top and bottom sheet and fastened therebetween creating a pair of side by side chambers with each having its own vent in conduit communication with the ventilator unit incorporating a heater and a fan working independently of each other so that one can select either ambient air or heated air and the volume of desired air through settings such as low, medium or high volume.

15 Claims, 10 Drawing Sheets

BED VENTILATOR UNIT

BACKGROUND OF THE INVENTION

1. Field of the Invention

The present invention relates generally to bedding and, more specifically, to a ventilating system for a bed for selectively venting either ambient air or heated air into the bed linen of a bed approximate the foot of the bed through a pair of vents clipped to the mattress in spaced apart fashion.

The instant invention further provides a pliable partition longitudinally extending the length of the top and bottom sheet and fastened therebetween creating a pair of side by side chambers with each having its own vent in conduit communication with the ventilator unit incorporating a heater and a fan working independently of each other so that one can select either ambient air or heated air and the volume of desired air through settings such as low, medium or high volume. The temperature of the heated air is also selectable through settings such as low medium or high.

The present invention further provides an additional element having a top sheet with the pliable barrier attached only to the top sheet providing for unencumbered movement by the users between the chambers as desired with the barrier member still serving to segregate the bed into opposing chambers.

Also optionally provided for are sheet blanket clips for securing the divided sheet to the rest of the upper bedding, blankets, comforters, etc, to help the pliable barrier stay centered and in order on the bed.

2. Description of the Prior Art

There are other ventilating devices designed for climate control of bedding. Typical of these is U.S. Pat. No. 2,560,349 issued to Inglis on Jul. 10, 1951.

Another patent was issued to Starr on Dec. 30, 1975 as U.S. Pat. No. 3,928,876. Yet another U.S. Pat. No. 5,730,120 was issued to Yonkers, Jr. on Mar. 24, 1998 and still yet another was issued on Nov. 5, 2002 to Augustine et al. as U.S. Pat. No. 6,473,920.

Another patent was issued to Heaton on May 4, 2004 as U.S. Pat. No. 6,730,115. Yet another U.S. Patent Application No. 2005/0278863 was issued to Bahash et al. on Dec. 22, 2005. Another was issued to Schoettle on Feb. 27, 2007 as U.S. Pat. No. 7,181,786 and still yet another was issued on Dec. 2, 1986 to Bird as U.K. Patent No. GB2225535.

Another patent was issued to Hardouin on Jul. 13, 1990 as French. Patent No. FR2641455. Yet another German Patent No. DE10012617 was issued to Scherer on Sep. 20, 2001. Another was issued to Lin on Aug. 1, 2003 as French Patent No. FR2835164 and still yet another was issued on Feb. 8, 2006 to Spratley as U.K. Patent No. GB2416833.

U.S. Pat. No. 2,560,349

Inventor: Norman R. Inglis

Issued: Jul. 10, 1951

Air conditioning means comprising a housing having a partition mid way between its upper and lower ends, brackets depending from said partition and a motor positioned on said brackets, a shaft on said motor extending upwardly through the said partition, a fan on the said shaft and radially positioned louvers located thereabove for converting spinning air currents to vertical air currents, a heating element above the said louver and an outlet in the said casing, and a sleeve disposed in said outlet, thermostatic means located in said sleeve and controlling said heating element, and a secondary heating element located in said sleeve and above said thermostatic means and connected with said heating element and a flexible hose detachably positioned in said outlet for delivering air therefrom to a remote point of discharge.

U.S. Pat. No. 3,928,876

Inventor: Louis J. Starr

Issued: Dec. 30, 1975

A bed having a horizontal portion received beneath a person lying on the bed and through which air is circulated upwardly toward the person, with the bed also having a structure at its end projecting upwardly above the level of the horizontal portion and discharging air from that elevated location generally horizontally toward the person and preferably past an adjustable louver assembly. Both types of circulation are preferably produced by a fan contained within the mentioned end structure.

U.S. Pat. No. 5,730,120

Inventor: John L. Yonkers, Jr.

Issued: Mar. 24, 1998

A bed ventilator includes an electric motor driven axial flow fan for moving air between a mattress and a bed cover thereon. The fan and associated duct work is mounted on a thin flat support tongue extended beneath the mattress and sandwiched between the mattress and its supporting bed structure such as a box spring. The associated duct work includes telescopic duct sections adjustable to accommodate mattresses of different thickness and locking screws are provided for securing a selected telescopic relation between the duct sections for a particular mattress involved.

U.S. Pat. No. 6,473,920

Inventor: Scott Douglas Augustine et al.

Issued: Nov. 5, 2002

A warming system, mounted to the foot of a bed, warms a person's lower extremities by directing air into the space between the mattress and overlaying blankets. A blower directs air into an elongated distribution chamber having many tiny exit apertures. The chamber is mounted at the foot of the bed, so that air exiting the apertures warms the person's feet. For maximum thermal transfer, the chamber is placed under the sheet and any blankets, but above the mattress cover and fitted sheet. The chamber may be implemented by a length of open cell foam, a hollow manifold with many punctures or other tiny distribution apertures, collapsible pocket, etc. While the person is lying on the bed beneath the blankets, with feet proximate the foot of the bed, the blower directs temperature-regulated air into the chamber and through the exit apertures, thereby warming the person's feet. A temperature regulator ensures a normothermic air temperature (or alternatively, hyperthermic air temperature.) Thus, the invention helps relieve or prevent "cold feet" by directing normothermic air at a person's lower extremities. Additionally, by applying heat to the feet and legs, the invention encourages blood flow by virtue of sympathetic vasodilation and local temperature-mediated vasodilation. The invention is also believed to prevent some leg and foot ulcers from forming by maintaining the lower extremity at a near normal temperature during sleep.

U.S. Pat. No. 6,730,115

Inventor: Keith Patrick Heaton

Issued: May 4, 2004

A cooling system for cooling a person in a supine position as part of a clinical treatment includes an air blower, a heat exchanger, an inflatable mattress and a cooling jacket or overlay. Air from the blower is cooled by contact with the heat exchanger, passed through the jacket or overlay and through the mattress in order to rapidly cool the person so as to achieve mild hypothermia.

U.S. Patent Application Number 2005/0278863

Inventor: Lisa Jane Bahash

Issued: Dec. 22, 2005

An improved comfort product that uses an airflow through a heat exchanger and into the comfort product to selectively heat or cool an occupant has a support layer contacting and supporting a channel layer. The channel layer has at least one channel with an opening to accept air. The channel layer contacts and supports an engineered distribution layer that has numerous small holes making it air permeable. The engineered distribution layer contacts and supports an air permeable comfort layer that is of such size and shape to support an occupant of the comfort product. The comfort product also has a heat exchanger assembly for supplying heated or cooled air to the opening in the channel. The heat exchanger assembly includes an air intake having an intake fan, an exhaust outlet and a heat exchanger for selectively heating or cooling air flowing through the heat exchanger resulting in selectively heated or cooled supply air and exhaust air. The intake fan forces air through the heat exchanger where some of the air is selectively heated or cooled to be supplied to the comfort product and some air is used as exhaust air (to remove the unwanted heat if the supplied air is cooled or to warm the exhaust side of the heat exchanger if the supply air is warmed.). The selectively heated or cooled supply air then moves through the channels in the channel layer and the exhaust air exits through the exhaust vent. The selectively heated or cooled supply air then moves through the engineered distribution layer where the numerous small holes diffuse the air and then the selectively heated or cooled air then moves through the comfort layer where the air is further diffused and where the selectively heated or cooled air can selectively heat or cool an occupant of the comfort product.

U.S. Pat. No. 7,181,786

Inventor: Guenther Schoettle

Issued: Feb. 27, 2007

The invention being submitted pertains to a bed, consisting of a bedstead (1) and a mattress (2), whereby an air-conduction unit (4) is integrated in the bedstead. Along one or more lateral walls (3) of the bedstead (3), side ducts (6) are provided with lateral escape ports (5) for the out-flow of air from the air-conduction unit (4). Additionally, a mattress air-chamber (10) is provided with the upper escape ports (8) for the discharge of air from the air-conduction unit (4).

U.K. Patent Number GB2225535

Inventor: Peter Stephen Bird

Issued: Jun. 6, 1990

A personal air conditioning appliance, through the circulation of temperature and/or ingredient, adjusted air within an enclosed personal environment, and having both static and mobile applications.

French Patent Number FR2641455

Inventor: Francois Duparc Hardouin

Issued: Jul. 14, 1990

The present invention relates to an air-conditioning device, particularly for a bed 7 or the like, of the type comprising a housing 2 containing the air-conditioning means 4 and means 5 for pumping the conditioned air. According to the invention, the device comprises a tube 6 connected to said housing 2, through which conditioned air is conveyed to said bed, said tube 6 being provided with a plurality of outlet holes 8 by means of which the conditioned air traveling along said tube escapes at exactly the required location and in the desired direction.

German Patent Number DE10012617

Inventor: Hans Scherer

Issued: Sep. 20, 2001

The sleeping position comprises a tunnel through which air at controlled temperature flows. This is provided by an individual ventilator driven by an electric motor or by a central heating/ventilating system in mass accommodation.

French Patent Number FR2835164

Inventor: Lin Ku Shen

Issued: Aug. 1, 2003

The mattress (1) is provided with air releasing buttons (11) joined to its top and accommodated in small concave spaces. A separate fan element (25) positioned inside a housing (2) and joined to a supply duct (3) creates a stream of hot (22) or cold air (21) and transports a pleasant smell from a scent container (25) also located inside the housing (2) to the openings (112) provided at the buttons (11). The temperature is controlled by a thermostat (27).

U.K. Patent Number GB2416833

Inventor: David Derek Grant Spratley

Issued: Feb. 8, 2006

A unit is suitable for introducing air into a space between a bed 'B' and a bed cover 'C', and in use, the bed cover is at least partially suspended from the unit, allowing air to circulate within the space. The unit may include an upright tubular housing 10 with an associated fan, and means to heat or cool the airflow. The air may be drawn in via inlets 14 formed on opposite sides of the housing, and expelled through a flexible delivery pipe (15 FIG. 1) which projects from the housing and extends into the space under the bed cover. The unit may also include an elongate telescopic assembly 18 extending horizontally over the bed from the top of the upright body. The telescopic assembly may include adjustable lateral support arms 20, 22, which include height adjustable filaments, such as cords 24, with means for fastening to the bed cover, such as clips 26. The arms may include several articulation points for pivoting the arm outer members 21, 23. The unit may also include a stabilizing foot assembly including telescopic feet 12 extending under the bed from the base of the upright body. The upper part 16 of the tubular housing may be adjusted vertically, and adjustment of height and air temperature may be effected by remote control.

While these bedding appliances may be suitable for the purposes for which they were designed, they would not be as suitable for the purposes of the present invention, as hereinafter described.

SUMMARY OF THE PRESENT INVENTION

A primary object of the present invention is to provide a means for individually venting both sides of bed.

Another object of the present invention is to provide a ventilating system for a bed whereby each side of the bed can have a different temperature.

Yet another object of the present invention is to provide a ventilating system comprising a ventilator unit having a pair of conduits terminating in a pair of vents attachable to a bed.

Still yet another object of the present invention is to provide a ventilating system wherein said vents incorporate clips whereby the vents can be clipped onto a mattress.

A further object of the present invention is to provide a ventilating system wherein said vents have pivotal fins and linkage for directing the flow of air exiting said vent.

A yet further object of the present invention is to provide a ventilating system further comprising bed linen having a top sheet and a bottom fitted sheet with a longitudinal pliable barrier fixed therebetween.

A still yet further object of the present invention is to provide a ventilating system alternately providing that the barrier element is attached only to the top sheet.

An additional object of the present invention is to provide a ventilating system further comprising a remote control unit for engaging and disengaging the functions of the ventilator unit.

Another object of the present invention is to provide a ventilating system wherein the remote control unit can be hard wired or wirelessly connected to the ventilator unit.

Additional objects of the present invention will appear as the description proceeds.

The present invention overcomes the shortcomings of the prior art by providing a ventilating system for a bed for selectively venting either ambient air or heated air into the bed linen of a bed approximate the foot of the bed through a pair of vents clipped to the mattress in spaced apart fashion. with a pliable partition longitudinally extending the length of the top and bottom sheet and fastened therebetween creating a pair of side by side chambers with each having its own vent in conduit communication with the ventilator unit incorporating a heater and a fan working independently of each other so that one can select either ambient air or heated air and the volume of desired air through settings such as low, medium or high volume. The temperature of the heated air is also selectable through settings such as low medium or high. Also provided is a top sheet with the pliable barrier attached only to the top sheet providing for unencumbered movement by the users between the chambers as desired with the barrier member still serving to segregate the bed into opposing chambers.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
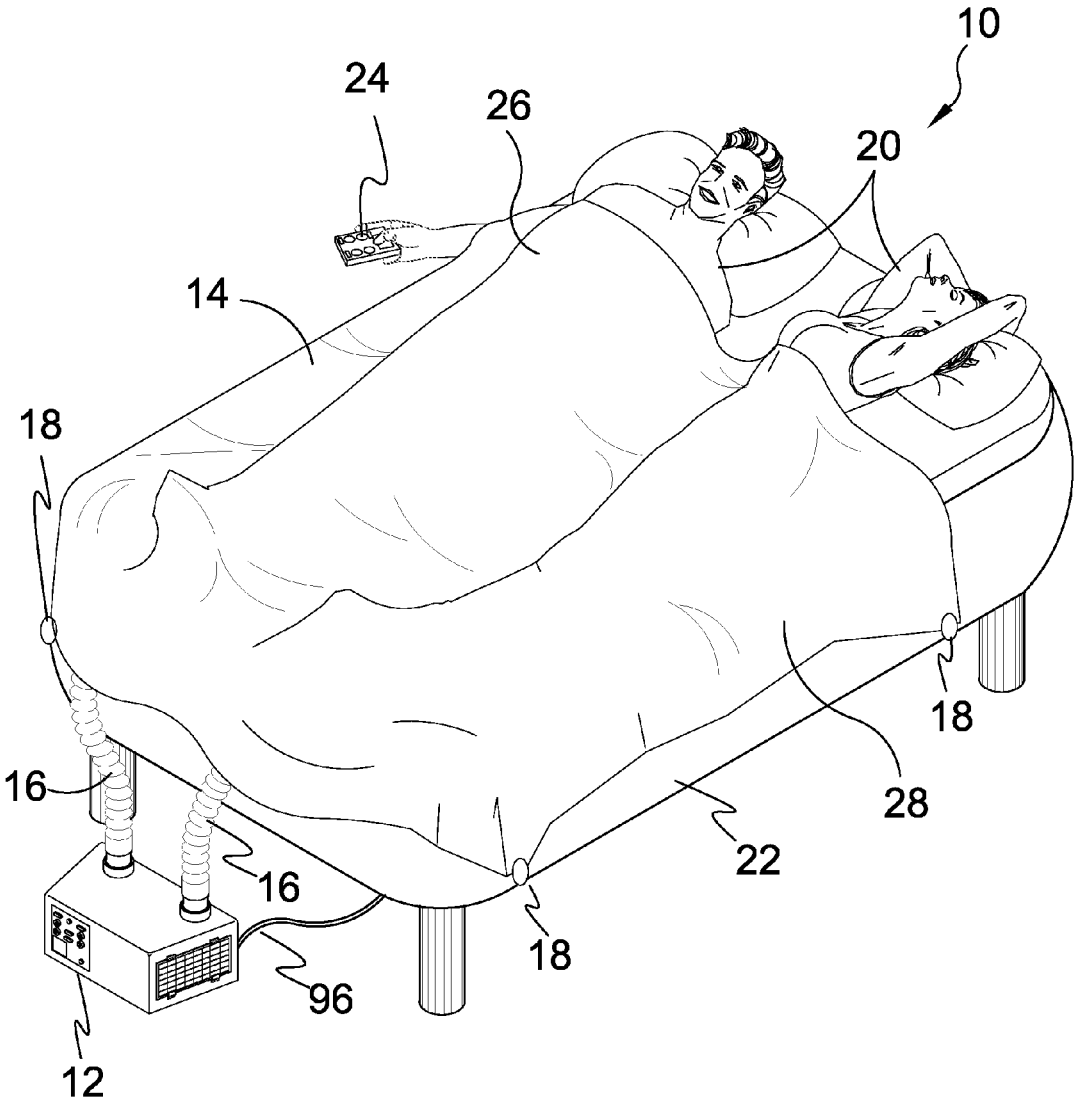
FIG. 1 is an illustrative view of the ventilator of the present invention in use.

Turning now descriptively to the drawings, in which similar reference characters denote similar elements throughout the several views, the figures illustrate the Bed Ventilator Unit of the present invention. With regard to the reference numerals used, the following numbering is used throughout the various drawing figures.

| | |
|---|---|
| 10 | Bed Ventilator Unit of the present invention |
| 12 | ventilator unit |
| 14 | bed sheet |
| 16 | flexible retractable hose |
| 18 | sheet/blanket clamp |
| 20 | user |
| 22 | bed |
| 24 | remote control |
| 26 | first vented chamber |
| 28 | second vented chamber |
| 30 | first flex hose |

-continued

| | |
|---|---|
| 32 | second flex hose |
| 34 | vent |
| 36 | female flex hose coupling |
| 38 | male vent coupling |
| 40 | male ventilator unit coupling |
| 42 | user controls |
| 44 | lever |
| 46 | top sheet |
| 48 | fitted bottom sheet |
| 50 | pliable partition |
| 52 | fan |
| 54 | heater |
| 56 | wireless remote unit |
| 58 | hardwired remote unit |
| 60 | remote wire |
| 62 | on unit display |
| 64 | on/off button |
| 66 | side "A" control |
| 68 | side "B" control |
| 70 | heat control |
| 72 | heat symbol |
| 74 | fan symbol |
| 76 | timer |
| 80 | constant |
| 90 | fan control |
| 92 | heated air |
| 94 | ambient air |
| 96 | power cord |

DETAILED DESCRIPTION OF THE PREFERRED EMBODIMENT

The following discussion describes in detail one embodiment of the invention. This discussion should not be construed, however, as limiting the invention to those particular embodiments; practitioners skilled in the art will recognize numerous other embodiments as well. For definition of the complete scope of the invention, the reader is directed to appended claims.

FIG. 1 is an illustrative view of the bed ventilator of the present invention 10 in use. The present invention is a ventilator unit 12 including a divided bed sheet 14 having subdivided vented chambers 26,28 that are clamped 18 to the mattress 22 on their respective side of the divided sheet 14 whereby each user 20 can set their preferential temperature setting. The ventilator unit 12 having power cord 96 incorporates a heater and a fan that work independently so that one user 20 can select heat while the other selects air fed therein through flexible hoses 16. The divided bed sheet 12 has a longitudinal pliable barrier which segregates the first vented chamber 26 from the second 28 with the present invention optionally provided sheet blanket clips 18 for securing the divided sheet 14 to the rest of the upper bedding, blankets, comforters, etc, to help the pliable barrier stay centered and in order on the bed.

Figure 2:
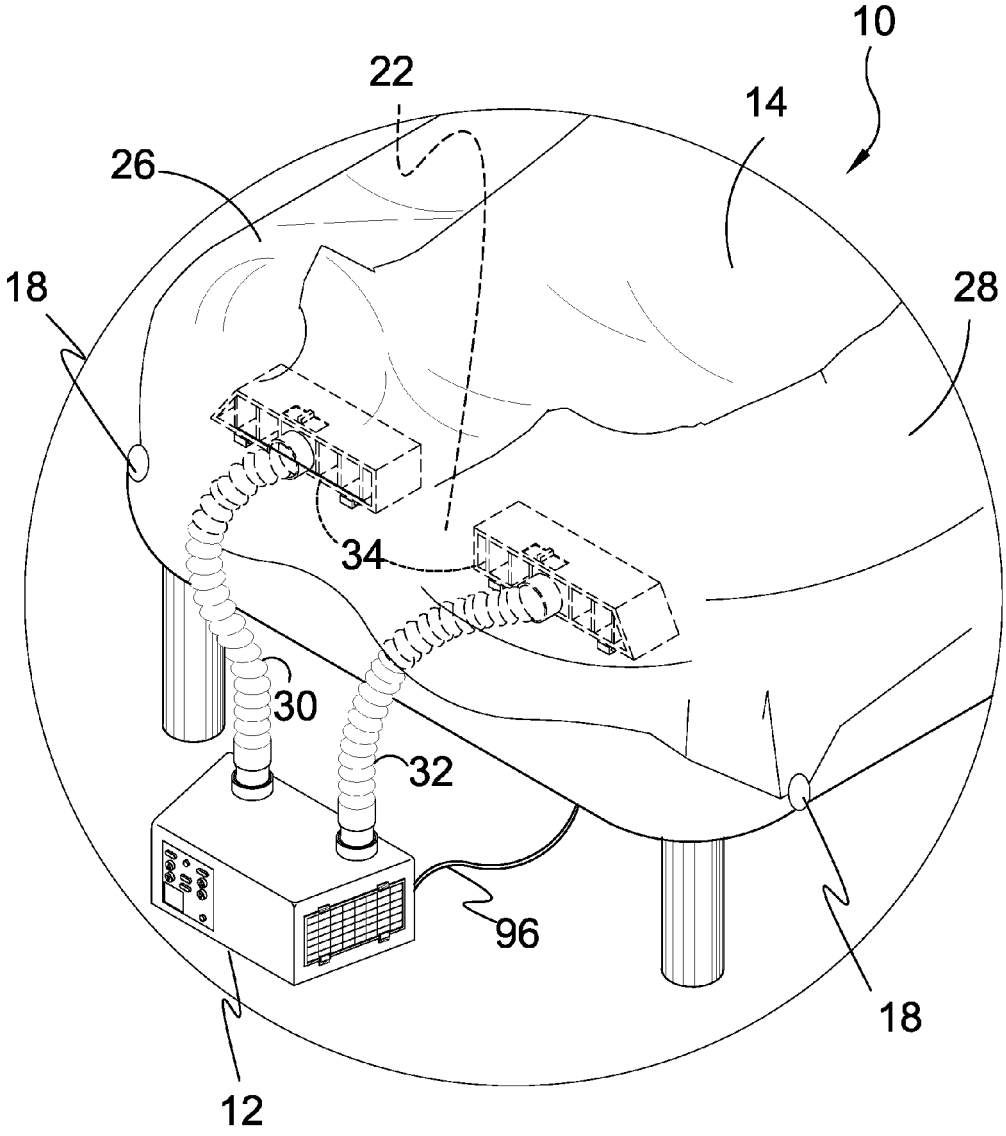
FIG. 2 is an illustrative view of the air delivery portion of the present invention.

FIG. 2 is an illustrative view of the air delivery portion of the present invention 10. The present invention 10 provides apparatus for selectively venting either ambient air or heated air into a sheet 14 having subdivided vented chambers 26, 28 of bed linen of a bed approximate the foot of the bed through a pair of vents 34 clipped to the mattress 22 in spaced apart fashion. The instant invention further provides a top sheet and bottom sheet with the top sheet of greater length. A pliable partition portion conjoins the top and bottom sheet creating a pair of side by side chambers with each having its own vent 34 in conduit communication by a first flex hose 30 and a second flex hose 32 with the ventilator unit 12 having power cord 96 is comprised of a heater and a fan working independently of each other so that one can select either ambient air or heated air and the volume of desired air through settings such as low, medium or high volume. The temperature of the heated air is also selectable through settings such as low medium or high. Additionally sheet/blanket clamps 18 are provided to attach the top sheet to the rest of the bedding to form a more efficient seal and trap air more efficiently.

Figure 3:
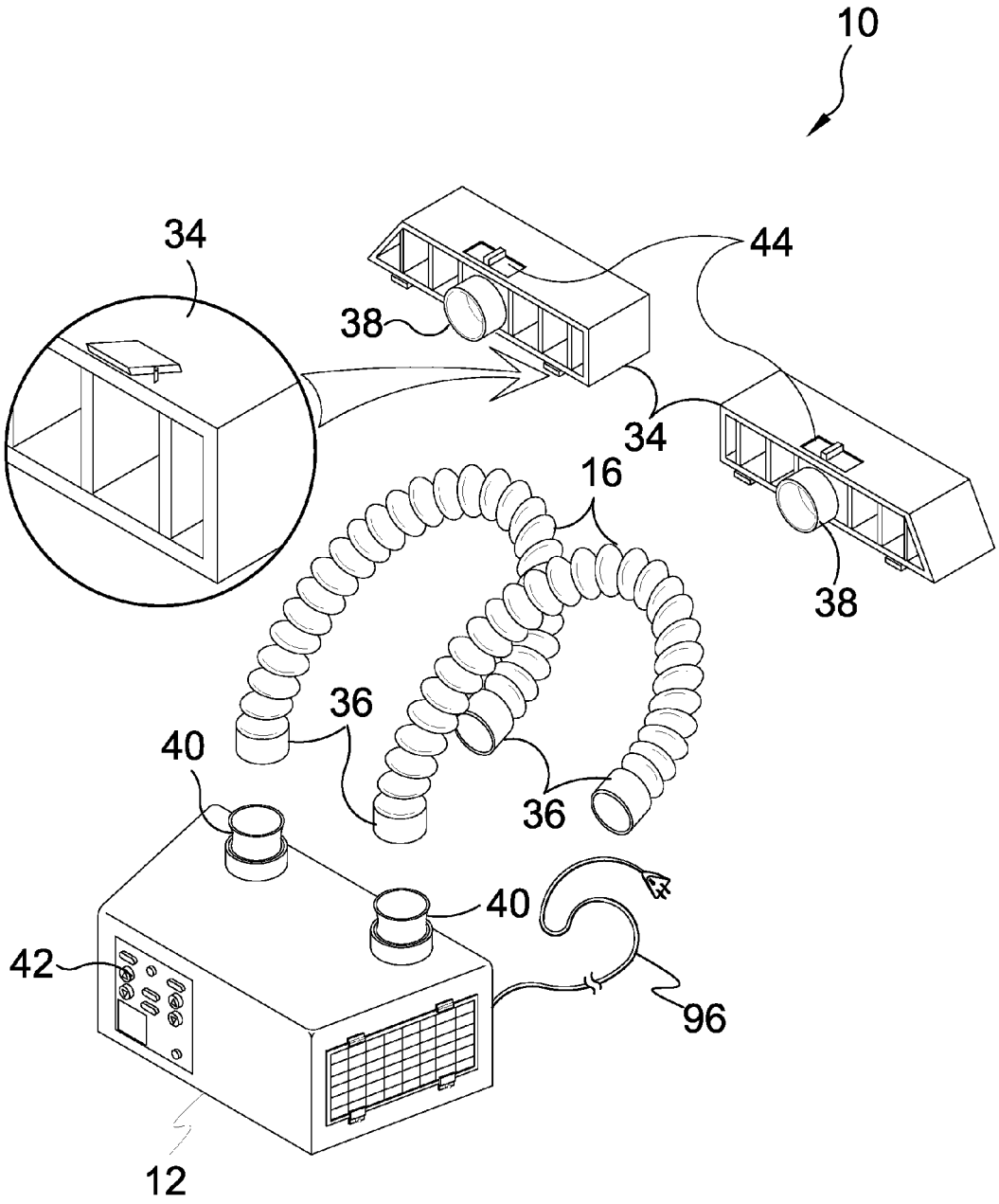
FIG. 3 is an illustrative view of the ventilator of the present invention.

FIG. 3 is an illustrative view of the ventilator of the present invention 10. The ventilation unit 12 communicates with the vents 34 via flex hoses 16 with each end having a female coupling 36 that mates with a respective male ventilator unit coupling 40 and the male vent coupling 38. The ventilator unit 12 further provides user controls 42 for varying air flow volume and heater temperature. Additionally shown are the vents 34 having levers 44 to direct air flow through the fins in a preferred direction.

Figure 4:
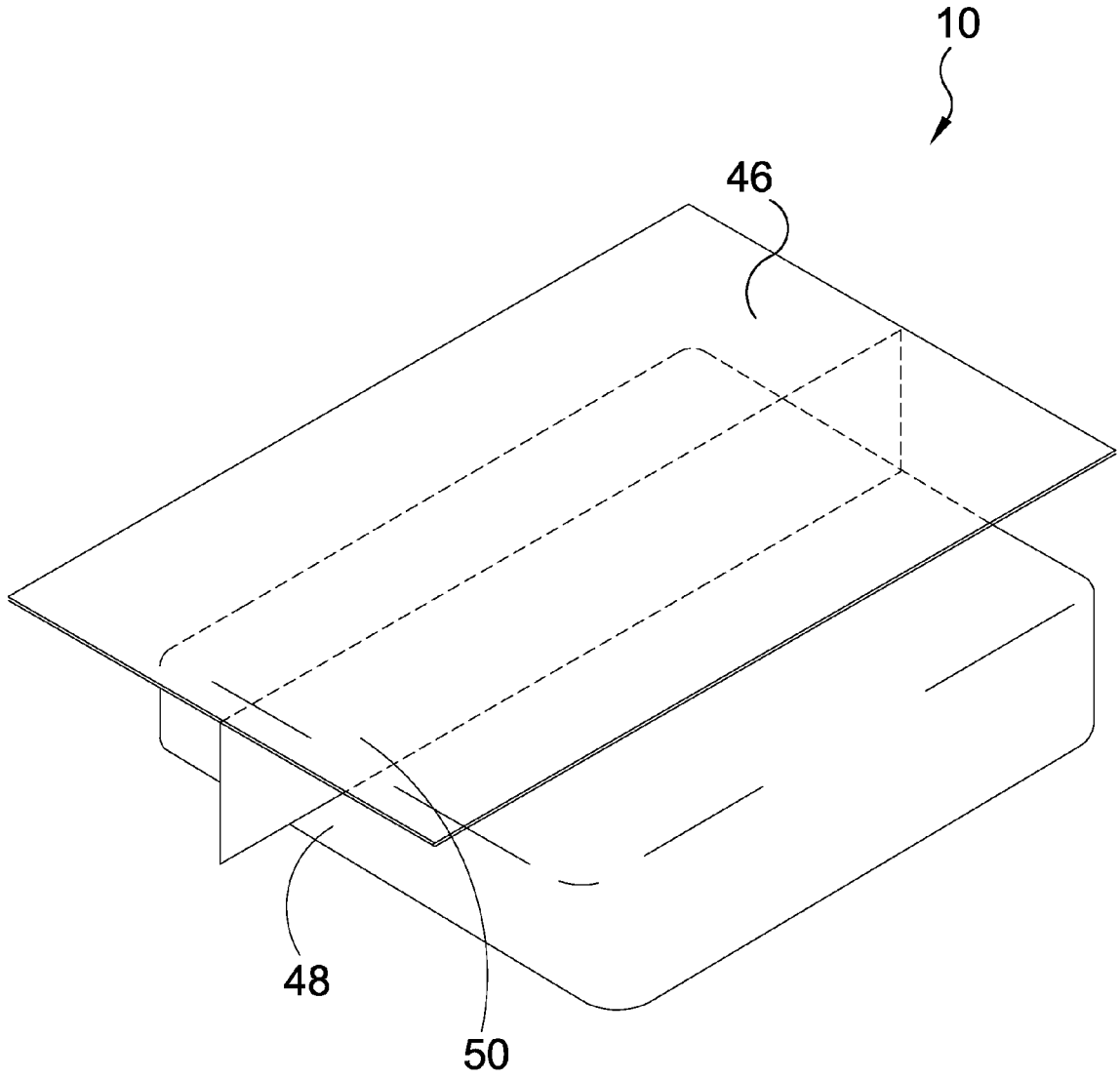
FIG. 4 is an illustrative view of the present invention.

FIG. 4 is an illustrative view of the present invention 10. Shown is the bed linen comprising a fitted bottom sheet 48 and a top sheet 46 having a pliable partition 50 attached therebetween. The pliable partition 50 serves to segregate the bed linen into opposing compartments each having its own vented in conduit communication with the ventilator unit whereby each user can select their own desired settings ranging from fan driven ambient air to fan driven heated air. The ventilator unit settings provide for variable fan speeds and heat settings. The present invention 10 further provides that the pliable partition 50 may or may not be secured or sewn to the bottom sheet providing for unimpeded movement between chambers.

Figure 5:
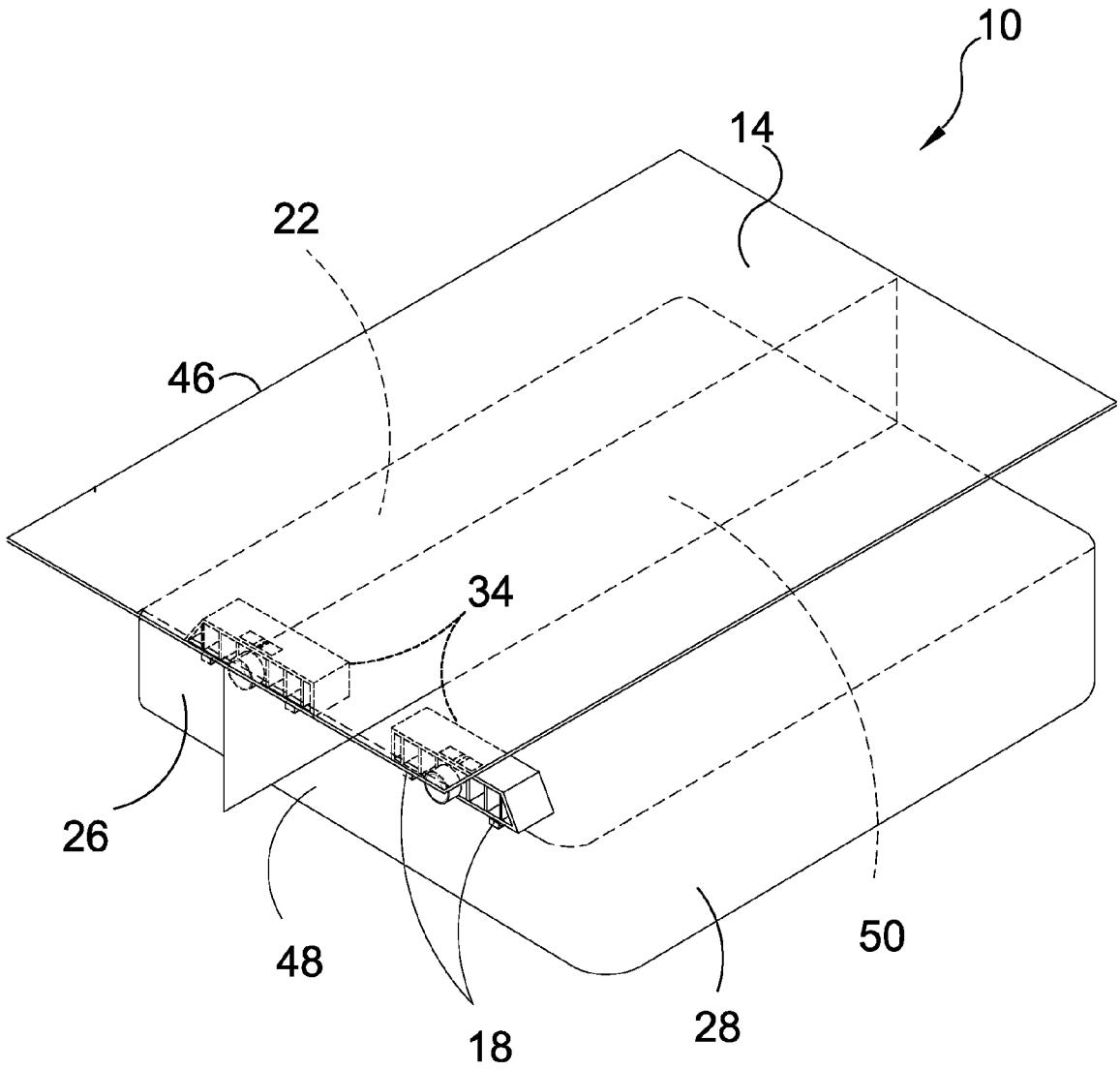
FIG. 5 is an illustrative view of the present invention.

FIG. 5 is an illustrative view of the present invention 10. Shown is the bed sheet 14 comprising a fitted bottom sheet 48 and a top sheet 46 having a pliable partition 50 attached therebetween with the top sheet 46 and partition elements 50 extending beyond the bottom sheet 48. The bottom sheet 48 is fitted over a mattress 22 wherethen the vents 34 are clamped 18 to the foot of the mattress 22. The partition 50 serves to segregate the bed linen into a first chamber 26 and a second chamber 28 each having its own vent 34 so that each user can select their own desired settings ranging from fan driven ambient air to fan driven heated air with the top sheet 46 and partition 50 extending over and between their respective vents 34.

Figure 6:
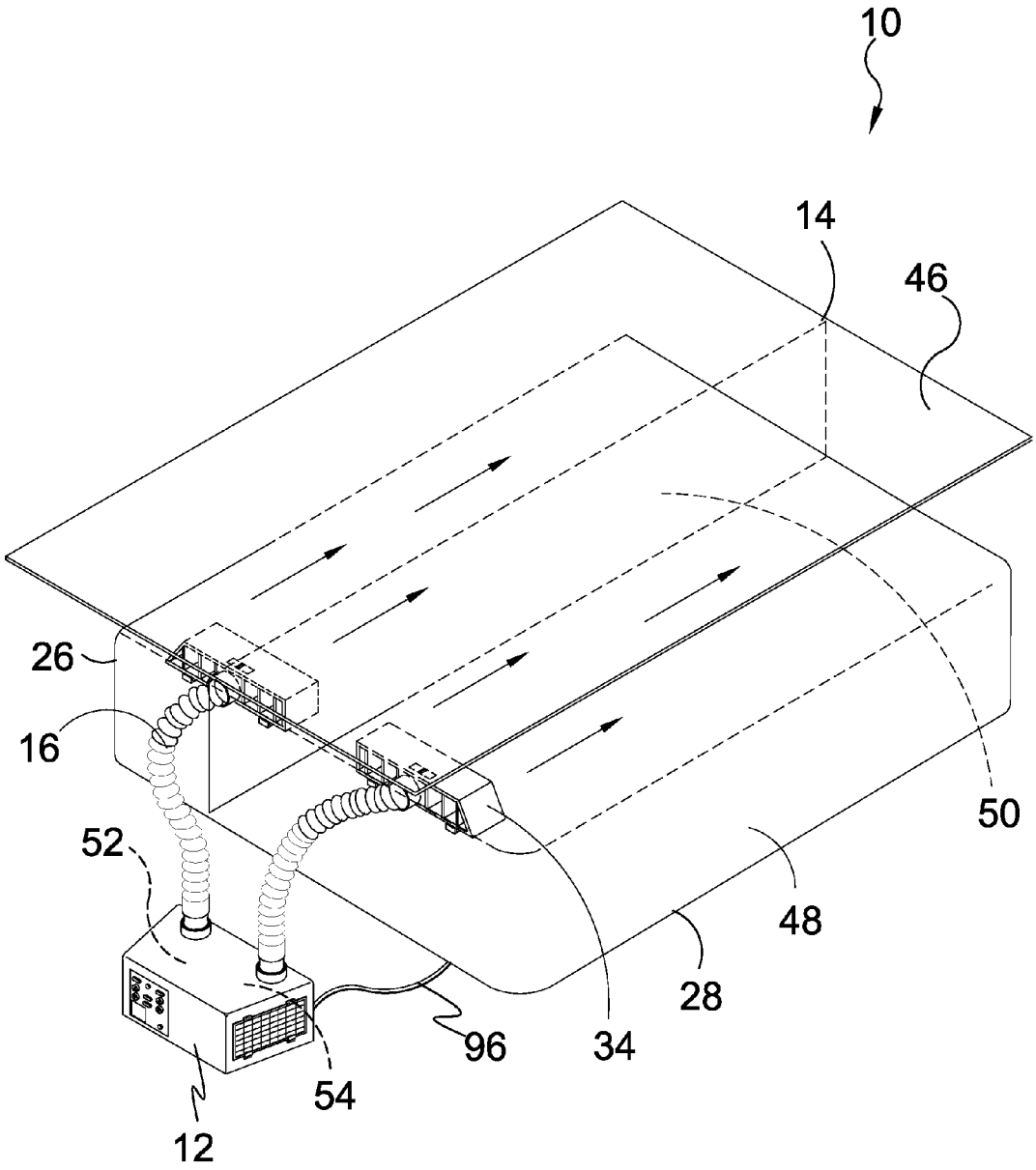
FIG. 6 is an illustrative view of the present invention.

FIG. 6 is an illustrative view of the present invention 10. Shown is the bed sheet 14 comprising a bottom sheet 48 and a top sheet 46 having a pliable partition 50 attached therebetween. The pliable partition 50 serves to segregate the bed sheet 14 into opposing chambers 26, 28 each having its own vent 34 in conduit 16 communication with the ventilator unit 12 whereby each user can select their own desired settings ranging from fan driven ambient air to fan driven heated air. The ventilator unit 12 settings provide for variable fan 52 speeds and heater 54 settings. The present invention 10 further provides that the partition 50 may or may not be secured or sewn to the bottom sheet 48 providing for unimpeded movement in the unattached state between compartments as desired.

Figure 7:
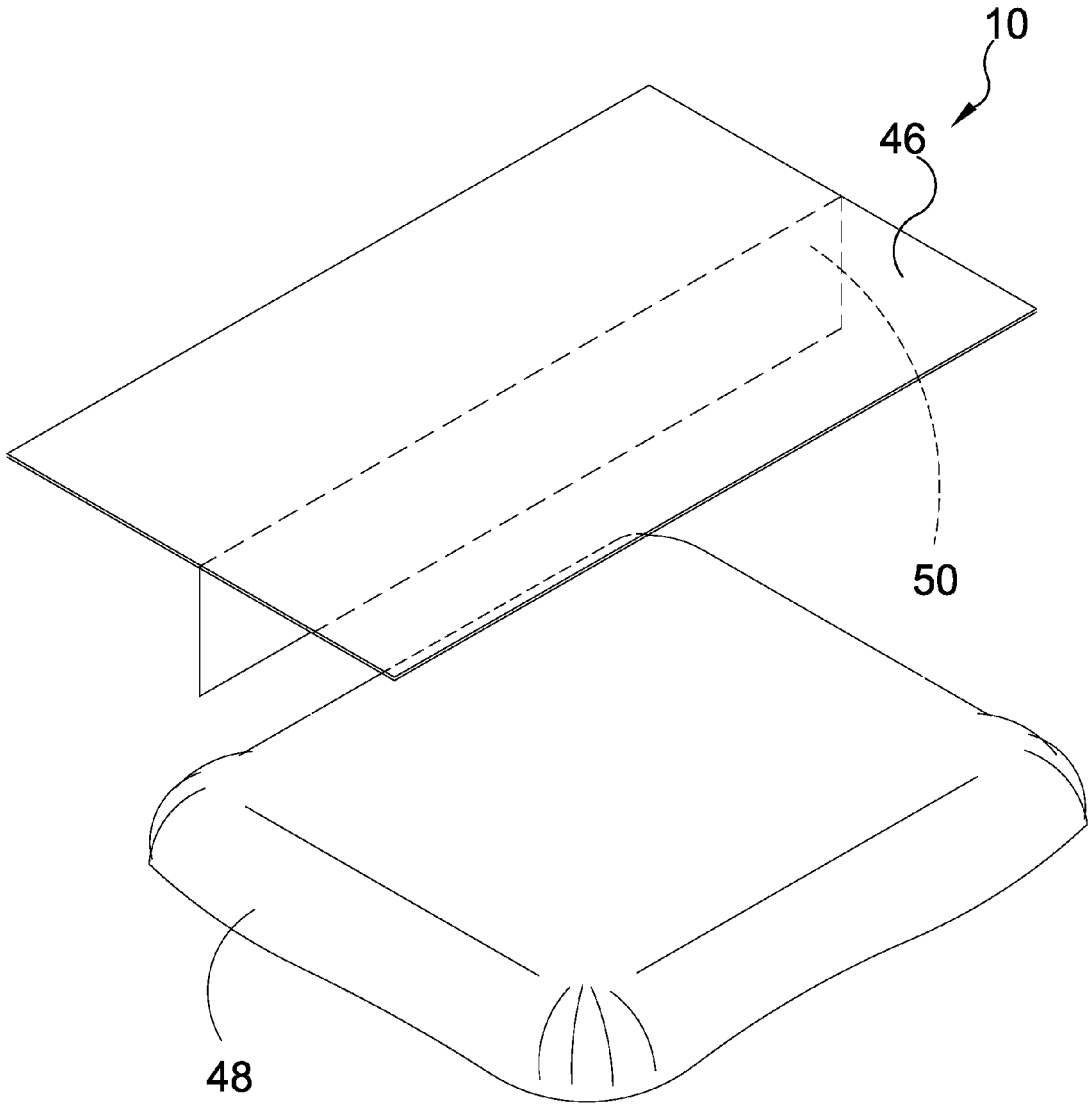
FIG. 7 is an illustrative view of an additional element of the present invention.

FIG. 7 is an illustrative view of an additional element of the present invention. Shown is the bed linen 14 comprising a bottom sheet 48 and a top sheet 46 with the partition element 50 attached only to the top sheet 46 providing for unencumbered movement by the users between the chambers as desired with the partition element 50 still serving to segregate the bed into opposing chambers.

Figure 8:
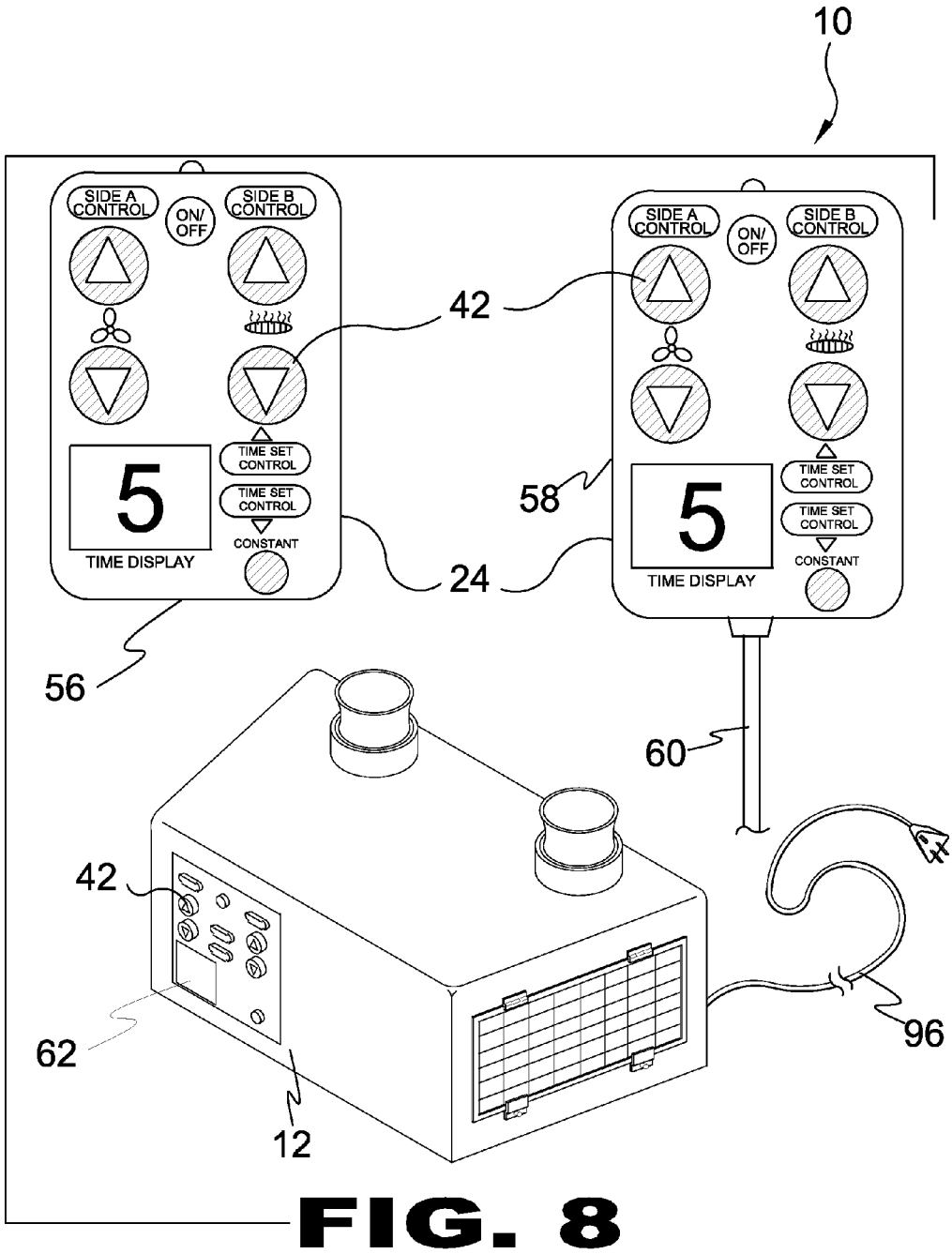
FIG. 8 is a view of various remote units that can be used in conjunction with the ventilator unit of the present invention.

FIG. 8 is a view of various remote units 24 that can be used in conjunction with the ventilator unit 12 of the present invention 10. The present invention 10 provides a wireless remote control unit 56 or a hardwired remote unit 58 having a wire 60 that can be used to engage and disengage the function of the ventilator unit 12. An on unit display 62 is provided on the ventilator unit 12 to display the output status thereof and ease of use of the user controls 42 disposed thereon. The ventilator 12 has power cord 96, which is plugged into a wall out providing electricity to ventilator unit 12.

Figure 9:
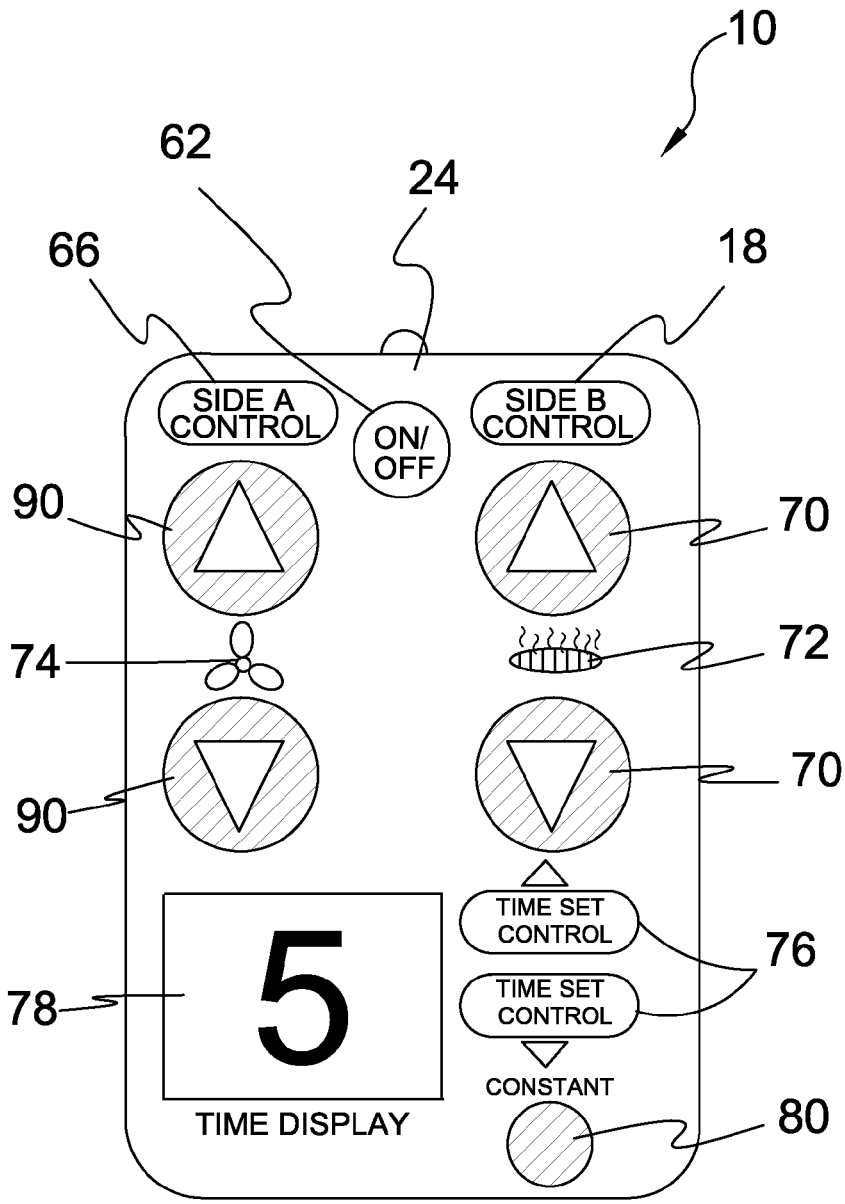
FIG. 9 is a frontal view of a remote control unit of the present invention.

FIG. 9 is a frontal view of a remote control unit 24 of the present invention 10 that allows the users to independently select their side then designate their own desired settings such as fan or heat, the amplitude of air and heat and duration of ventilation. Among the controls are an on/off button 62, side "A" control 66, side "B" control 68, fan controls 90, fan symbol 74, heat controls 70, heat symbol timer 76, time display 78, and constant 80.

Figure 10:
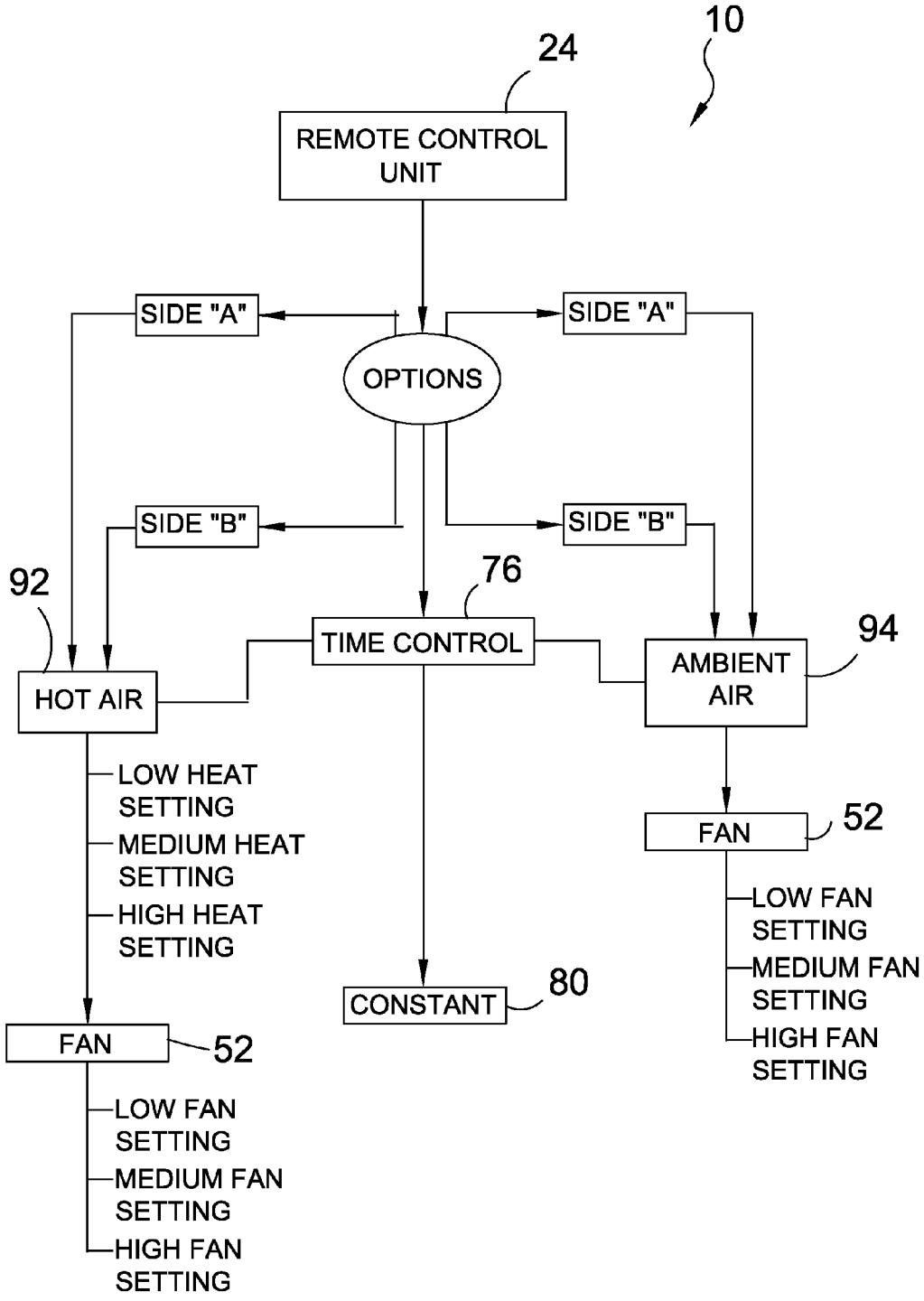
FIG. 10 is a flow chart of the bed ventilation system of the present invention.

FIG. 10 is a flow chart of the bed ventilation system of the present invention 10. The present invention 10 is a ventilating system for a bed incorporating a divided bed sheet with a vent for each chamber whereby each user can set their preferred settings with individual remote control units 24. The ventilator unit has a heater portion and fan 52 portions that work independently so that one user can select heated air 92 while the other selects ambient air 94 and are regulated by the timer 76 and the constant air control 80. The divided bed sheet has a longitudinal seam which separates one controlled temperature portion from the other.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bed ventilator comprising:

a) a divided bed sheet having first and second vented chambers of a size sufficient to accommodate a person;

b) a ventilating unit in conduit communication with each of said vented chambers; and c) a control unit for said ventilator unit, said control unit capable of activating said ventilating unit to direct air into either or both of said vented chambers, said divided bed sheet comprising a top sheet, a bottom sheet of greater length than said top sheet, and a longitudinal pliable partition conjoining said top and bottom sheets, with said top sheet and partition portion extending beyond said bottom sheet to form said first and second vented chambers in a side-by-side manner, with each of said vented chambers being in conduit communication with said ventilation unit.

2. A bed ventilator according to claim 1, wherein said ventilation unit comprises a fan.

3. A bed ventilator according to claim 2, wherein said ventilation unit further comprises a heater in conduit communication with each of said vented chambers.

4. A bed ventilator according to claim 3, wherein said control unit comprises controls for activating said fan and said heater independently to direct ambient or heated air into either of said vented chambers.

5. The ventilator unit according to claim 3, having housing with external controls for activating said fan and said heater independently to direct ambient or heated air into either of said vented chamber.

6. A bed ventilator according to claim 1 wherein said control unit further comprises controls for adjusting the intensity of air flow independently through said vented chambers.

7. A bed ventilator according to claim 6, wherein said control unit further comprises controls for adjusting the temperature of air flow independently through said vented chambers.

8. A bed ventilator according to claim 7 wherein said control unit intensity control includes settings for low, medium and high volume of air flow.

9. A bed ventilator according to claim 8 wherein said control unit temperature control includes settings for low, medium and high temperature of air flow.

10. A bed ventilator according to claim 8, further comprising a plurality of sheet blanket clips for securing said divided bed sheet to bedding placed over said divided bed sheet.

11. A bed ventilator according to claim 7, wherein said control unit is a wired remote control unit.

12. A bed ventilator according to claim 7, wherein said control unit is a wireless remote control unit.

13. A bed ventilator according to claim 1 wherein said longitudinal pliable partition portion attaches only to said top sheet to provide for unimpeded movement between chambers.

14. A bed ventilator according to claim 1, wherein said longitudinal pliable partition portion attaches to said top and bottom sheets in a removable manner to provide for unimpeded movement between chambers.

15. A method of ventilating a bed comprising the steps of:

a) providing a bed ventilator having: a divided bed sheet having first and second vented chambers, said divided bed sheet having a top sheet, a bottom sheet of greater length than said top sheet, and a longitudinal pliable partition portion conjoining said top and bottom sheets with said top sheet and partition portion extending beyond said bottom sheet to form said first and second vented chambers in a side-by-side manner with each of said vented chambers being in conduit communication with a ventilation unit; the ventilator unit having a fan and a heater each in conduit communication with each of said vented chambers; and a control unit for said ventilation unit, said control unit capable of activating said ventilation unit to control volume and temperature of air independently into each of said vented chambers;

b) securing said bed sheet to a mattress using clamps; and c) activating said control unit to control volume and temperature of air flow independently to each of said vented chambers.

* * * * *